US008881660B2

(12) United States Patent
Simpson et al.

(10) Patent No.: US 8,881,660 B2
(45) Date of Patent: Nov. 11, 2014

(54) SHELF ASSEMBLY

(71) Applicant: Electrolux Home Producs, Inc., Charlotte, NC (US)

(72) Inventors: Cory Dale Simpson, Abbeville, SC (US); Nilton Carlos Bertolini, Anderson, SC (US); Jeremy Van Hill, Boston, MA (US); Caleb Gossens, Anderson, SC (US); Justin Morgan, Anderson, SC (US); Paul Dubina, Anderson, SC (US)

(73) Assignee: Electrolux Home Products, Inc., Charlotte, NC (US)

( * ) Notice: Subject to any disclaimer, the term of this patent is extended or adjusted under 35 U.S.C. 154(b) by 0 days.

(21) Appl. No.: 13/709,324

(22) Filed: Dec. 10, 2012

(65) Prior Publication Data

US 2013/0146551 A1 Jun. 13, 2013

Related U.S. Application Data

(60) Provisional application No. 61/568,944, filed on Dec. 9, 2011.

(51) Int. Cl.

| | |
|---|---|
| ***A47B 9/00*** | (2006.01) |
| ***A47F 5/00*** | (2006.01) |
| ***F25D 1/00*** | (2006.01) |
| *A47F 5/08* | (2006.01) |
| *A47B 57/38* | (2006.01) |

(52) U.S. Cl.

CPC ... *A47F 5/00* (2013.01); *F25D 1/00* (2013.01); *A47B 57/38* (2013.01)

USPC ..... 108/108; 211/90.1

(58) Field of Classification Search

USPC ..... 108/106–108; 312/408, 404, 351; 211/153, 134, 187, 103; 248/235, 242, 248/244, 250

See application file for complete search history.

(56) References Cited

U.S. PATENT DOCUMENTS

| | | | | | |
|---|---|---|---|---|---|
| 291,030 | A | * | 1/1884 | Clapper | 108/1 |
| 471,481 | A | * | 3/1892 | Hart | 211/153 |
| 634,091 | A | * | 10/1899 | Newlee | 248/244 |
| 1,802,245 | A | * | 4/1931 | Foretich | 108/186 |
| 3,102,499 | A | * | 9/1963 | Shelor | 108/28 |
| 3,321,167 | A | * | 5/1967 | Hermann | 248/243 |
| 3,330,583 | A | * | 7/1967 | Kennedy et al. | 403/325 |
| 3,631,821 | A | * | 1/1972 | Zachariou | 108/152 |
| 4,262,809 | A | * | 4/1981 | McConnell | 211/192 |
| 4,936,641 | A | | 6/1990 | Bussan et al. | |

(Continued)

*Primary Examiner* — Jonathan Liu
*Assistant Examiner* — James Twomey
(74) *Attorney, Agent, or Firm* — Pearne & Gordon LLP

(57) ABSTRACT

A shelf assembly for an appliance includes a shelf panel comprising a generally planar support surface and a rear edge including a raised profile extending away from the support surface. A frame is configured to be mounted to an appliance to support the shelf panel with the support surface extending generally along a horizontal plane. The frame includes an elongated rear support member. A support channel extends at least partially into the rear support member, and is configured to removably receive and capture the rear edge of the shelf panel to inhibit removal of the shelf panel from the frame in the direction of the horizontal plane. The shelf panel is selectively removable from the support channel by tilting a front edge of the shelf panel upwards to a predetermined angle relative to the horizontal plane. A slide latch can selectively and lockingly engage corresponding support structure of an appliance.

17 Claims, 13 Drawing Sheets

(56) References Cited

U.S. PATENT DOCUMENTS

| | | | | | |
|---|---|---|---|---|---|
| 5,022,621 | A | * | 6/1991 | Quest | 248/243 |
| 5,228,764 | A | | 7/1993 | Cherry et al. | |
| 5,297,486 | A | * | 3/1994 | Herrmann et al. | 108/108 |
| 5,317,977 | A | * | 6/1994 | Omessi | 108/97 |
| 5,362,145 | A | | 11/1994 | Bird et al. | |
| 5,403,084 | A | | 4/1995 | Kane et al. | |
| 5,406,894 | A | | 4/1995 | Herrmann et al. | |
| 5,441,338 | A | | 8/1995 | Kane et al. | |
| 5,494,246 | A | * | 2/1996 | McCarthy et al. | 248/221.11 |
| 5,575,444 | A | * | 11/1996 | Otema | 248/242 |
| 5,799,803 | A | * | 9/1998 | Muller | 211/90.01 |
| 5,947,574 | A | | 9/1999 | Avendano | |
| 6,604,800 | B2 | | 8/2003 | Hamilton | |
| 6,851,776 | B2 | | 2/2005 | Bienick | |
| 6,871,923 | B2 | | 3/2005 | Dietz et al. | |
| 7,101,002 | B2 | | 9/2006 | Bienick | |
| 7,188,917 | B2 | | 3/2007 | Bienick | |
| D612,404 | S | | 3/2010 | Picken et al. | |
| 7,823,848 | B2 | * | 11/2010 | Haarmann | 248/250 |
| 8,333,448 | B2 | * | 12/2012 | Yoon et al. | 312/408 |
| 2002/0149304 | A1 | * | 10/2002 | Bienick | 312/408 |
| 2008/0000260 | A1 | | 1/2008 | Lim et al. | |
| 2009/0051257 | A1 | | 2/2009 | Picken et al. | |
| 2009/0084914 | A1 | | 4/2009 | Picken et al. | |
| 2009/0091230 | A1 | | 4/2009 | Picken et al. | |
| 2010/0026156 | A1 | * | 2/2010 | Leconte et al. | 312/408 |
| 2013/0002117 | A1 | | 1/2013 | Picken et al. | |

* cited by examiner

SHELF ASSEMBLY

CROSS-REFERENCE TO RELATED APPLICATIONS

This application claims the benefit of U.S. Provisional Application No. 61/568,944, filed Dec. 9, 2011, the entire disclosure of which is hereby incorporated herein by reference.

FIELD OF THE INVENTION

The present application relates generally to a shelf assembly, and more particularly, to a shelf assembly for an appliance.

BACKGROUND OF THE INVENTION

Appliances, such as refrigerators, are known to include a plurality of shelves for storing various items. Conventional shelves are beneficial to accommodate stored items such as large pizza boxes, wine bottles and/or other food or beverage containers.

BRIEF SUMMARY OF THE INVENTION

The following presents a simplified summary of the invention in order to provide a basic understanding of some example aspects of the invention. This summary is not an extensive overview of the invention. Moreover, this summary is not intended to identify critical elements of the invention nor delineate the scope of the invention. The sole purpose of the summary is to present some concepts of the invention in simplified form as a prelude to the more detailed description that is presented later.

In accordance with one aspect, a shelf assembly for an appliance comprises a shelf panel comprising a generally planar support surface, a front edge, and a rear edge comprising a raised profile extending away from the support surface. A frame is configured to be mounted to an appliance to support the shelf panel with the support surface extending generally along a horizontal plane, the frame comprising an elongated rear support member. A support channel extends at least partially into the rear support member. The support channel is configured to removably receive and capture the rear edge of the shelf panel to inhibit removal of the shelf panel from the frame in the direction of the horizontal plane. The shelf panel is selectively removable from the support channel by tilting the front edge of the shelf panel upwards to a predetermined angle relative to the horizontal plane.

In accordance with another aspect, a shelf assembly for an appliance comprises a shelf panel comprising a generally planar support surface and a rear edge arranged at an upwards angle with respect to the support surface. A frame is configured to be mounted to an appliance to support the shelf panel with the support surface extending generally along a horizontal plane, the frame comprising an elongated rear support member. A support channel extends at least partially into the rear support member and is configured to removably receive the rear edge of the shelf panel. The support channel is arranged at an upwards angle substantially corresponding to the upwards angle of the rear edge of the support surface.

In accordance with another aspect, a shelf assembly for an appliance comprises a shelf panel comprising a generally planar support surface and a rear edge comprising a raised profile extending away from the support surface. A frame is configured to be mounted to an appliance to support the shelf panel with the support surface extending generally along a horizontal plane. The frame comprises an elongated rear support member and a pair of hanger members configured to engage corresponding support structure of an appliance for supporting the frame. A support channel extends at least partially into the rear support member. The support channel is configured to removably receive and capture the rear edge of the shelf panel to inhibit removal of the shelf panel from the frame. A slide latch is coupled to the frame and comprises at least one raised projection configured to selectively and lockingly engage corresponding support structure of an appliance to inhibit removal of the hanger members from said support structure.

It is to be understood that both the foregoing general description and the following detailed description present example and explanatory embodiments of the invention, and are intended to provide an overview or framework for understanding the nature and character of the invention as it is claimed. The accompanying drawings are included to provide a further understanding of the invention and are incorporated into and constitute a part of this specification. The drawings illustrate various example embodiments of the invention, and together with the description, serve to explain the principles and operations of the invention.

BRIEF DESCRIPTION OF THE DRAWINGS

The foregoing and other aspects of the present invention will become apparent to those skilled in the art to which the present invention relates upon reading the following description with reference to the accompanying drawings, in which.

DESCRIPTION OF EXAMPLE EMBODIMENTS

Figure 1:
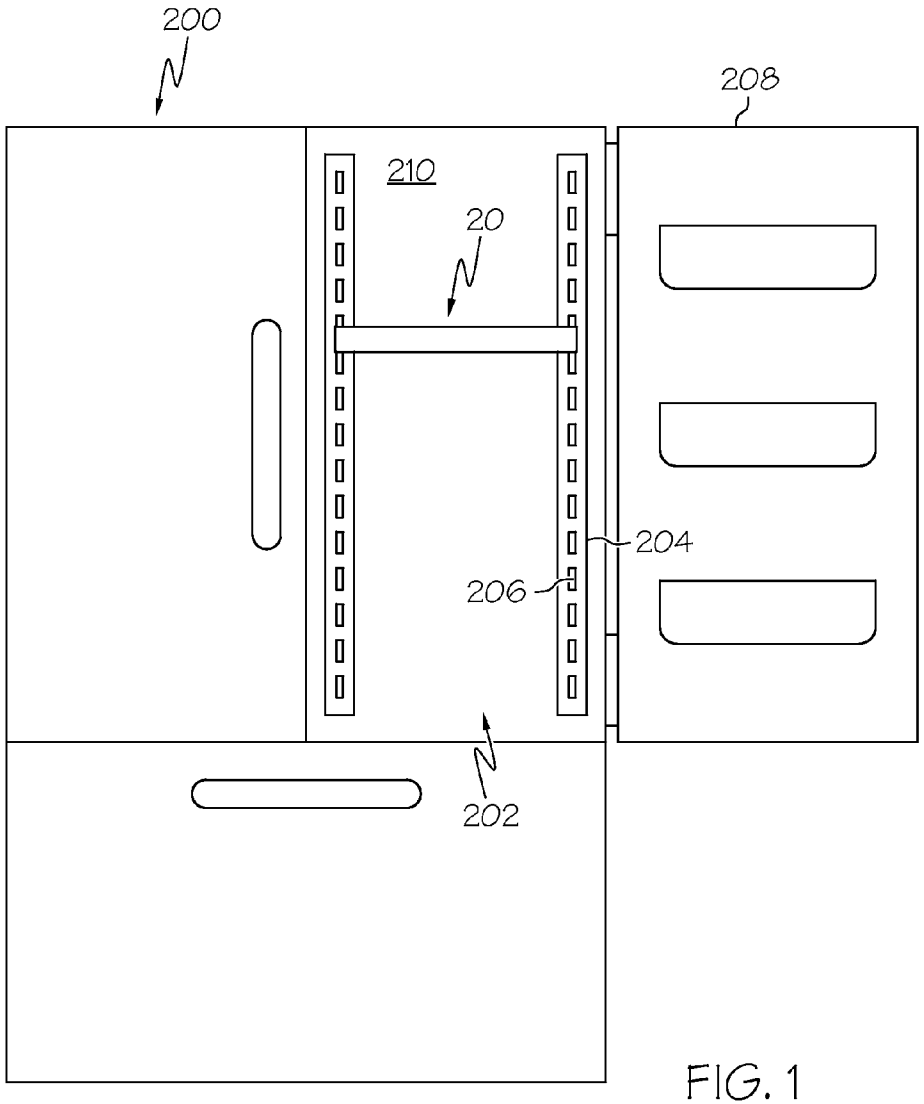
FIG. 1 is a schematic view of a refrigerator including an example shelf assembly.

Example embodiments that incorporate one or more aspects of the present invention are described and illustrated in the drawings. These illustrated examples are not intended to be a limitation on the present invention. For example, one or more aspects of the present invention can be utilized in other embodiments and even other types of devices. Moreover, certain terminology is used herein for convenience only and is not to be taken as a limitation on the present invention. Still further, in the drawings, the same reference numerals are employed for designating the same elements.

Turning to the shown example of FIG. 1, a shelf assembly is described that can be removed from a refrigerator while leaving a support frame in place. The removable portion of the shelf assembly includes materials that are dishwasher safe. Also, since the shelf panel is not permanently attached to the frame, the shelf panel can be taken out of the refrigerator and for use as a serving platter, for cleaning, or other uses.

The shelf assembly 20 can be used in different types of cabinets including storage systems for appliances, such as refrigeration appliances, freezers, dishwashers, ovens, or other appliance types. For instance, the shelf assembly 20 can be used in storage systems for refrigeration appliances such as refrigerator/freezer units, stand-alone refrigerators, standalone freezers, or the like. FIG. 1 depicts a schematic view of a refrigerator 200 including a schematic depiction of a shelf assembly 20 in accordance with aspects of the present application. In one example, the refrigerator 200 can include a cabinet with at least one wall 210 defining an interior area 202. A refrigerator door 208 can be opened to provide access to one or more shelf assemblies 20.

Moreover, it is contemplated that the shelf assembly 20 can include at least one hanger member configured to be attached with respect to the wall 210 of the cabinet 209 to support the shelf within the interior area 202 of the cabinet. In one example, one or more of the hanger members can include an interlocking device configured to be attached with respect to the wall 210 at a selected elevation with the hanger members acting as a cantilever support for the shelf. In the illustrated embodiment, a plurality of adjustment rails 204 are provided with vertically disposed apertures 206 to allow interaction with the interlocking device to maintain the shelf assembly 20 at the desired elevation within the interior area 202 of the cabinet 209.

Figure 2:
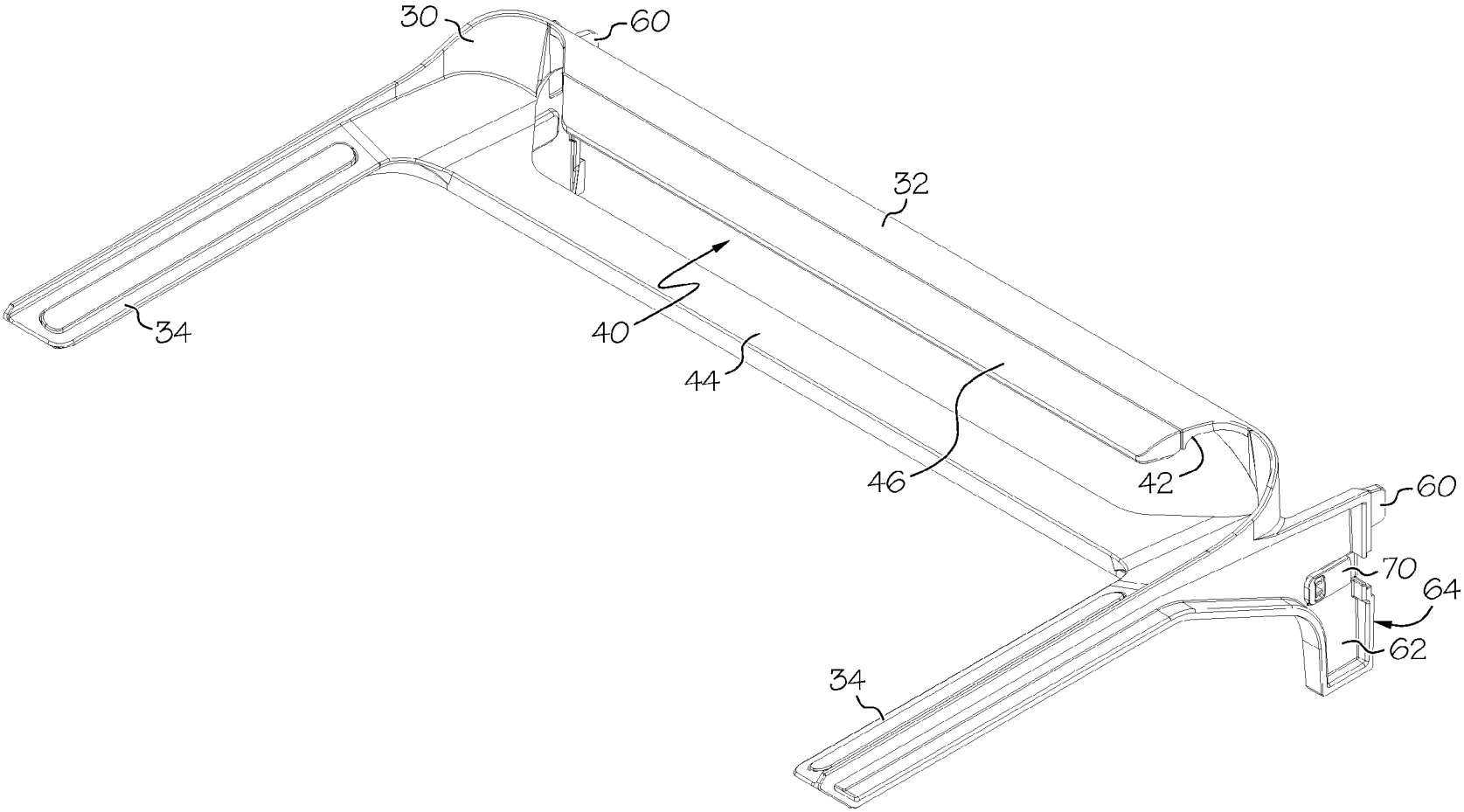
FIG. 2 is a perspective view of an example frame.
Figure 3:
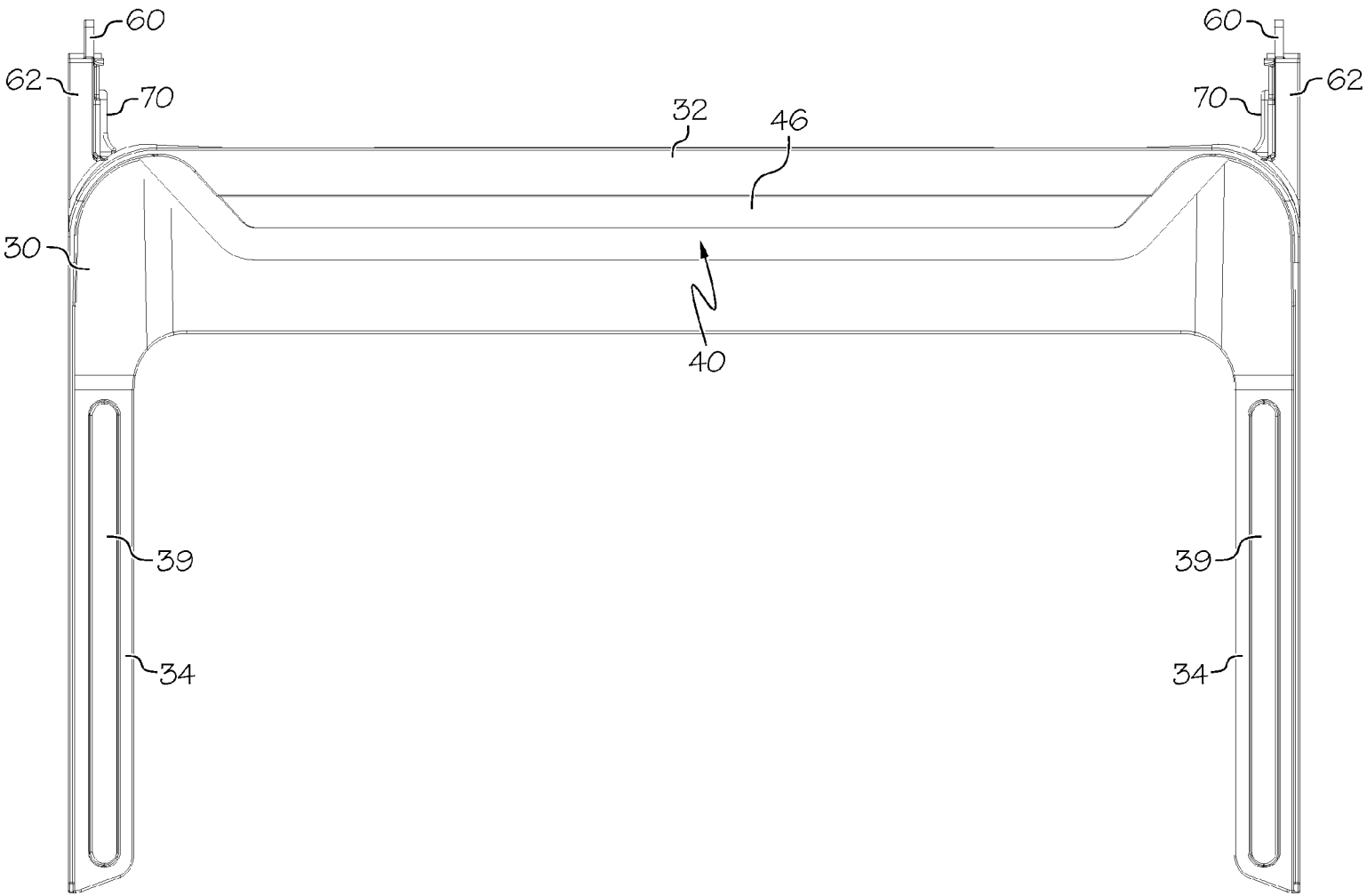
FIG. 3 is a top view of the example frame of FIG. 2.
Figure 4:
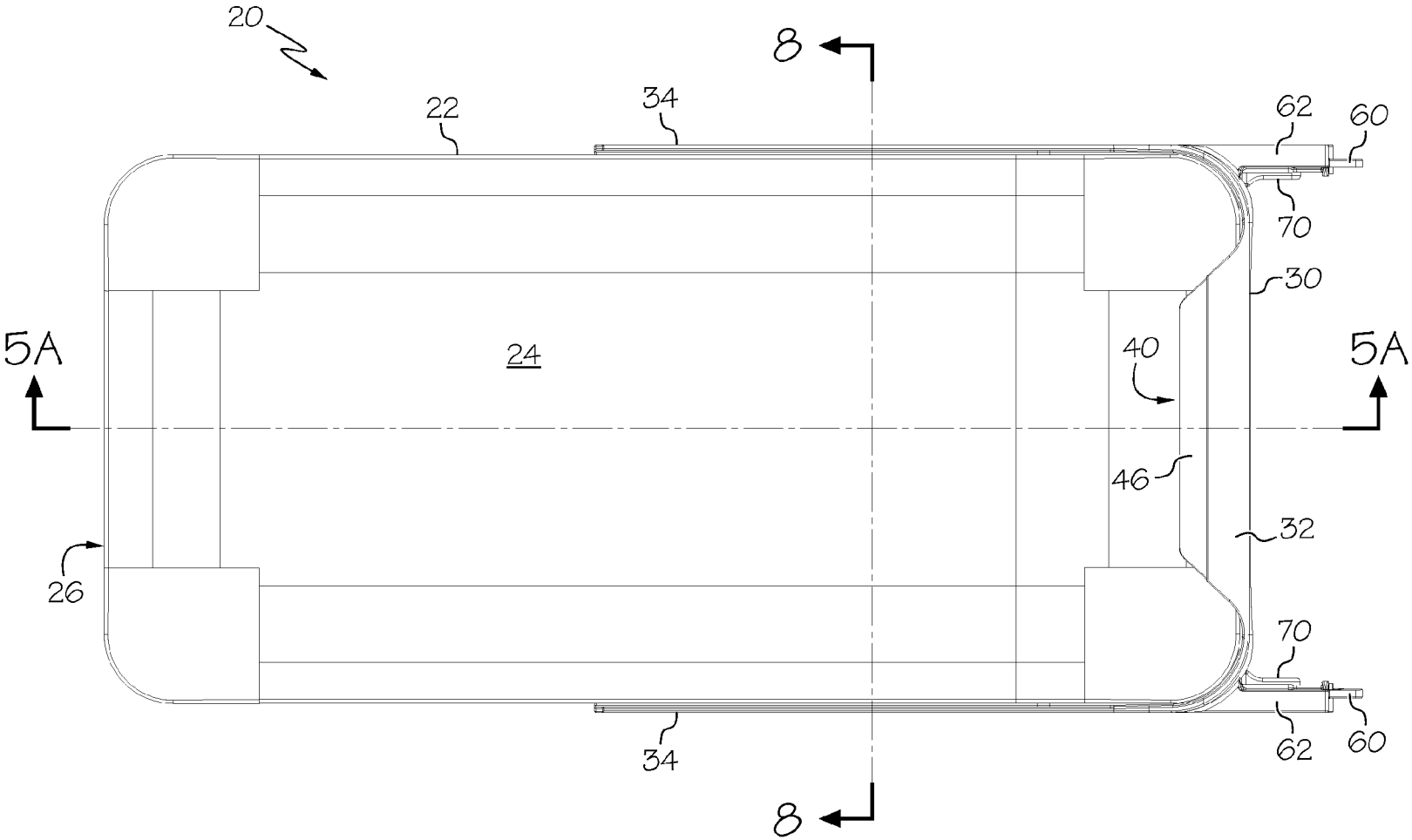
FIG. 4 is a top view of the example shelf assembly.

Turning now to FIGS. 2-4, the shelf assembly 20 includes a shelf panel 22 supported by a frame 30 with a generally planar support surface 24, a front edge 26, and a rear edge 28. The shelf panel 22 can have various shapes and dimensions with the generally planar support surface 24 configured to support various objects for storage. For example, the shelf panel 22 can be formed of various generally rigid materials, such as glass, plastic, metal, wire, or other suitable material. Preferably, the shelf panel 22 comprises a generally translucent or transparent material, such as a tempered or toughened glass or polymer panel suitable for use in a refrigerator environment. A tempered or toughened glass panel may further permit using the shelf panel as a cutting board or other food prep surface. The shelf panel 22 may include additional features, such as raised or angled edges extending along the outer perimeter (e.g., front, rear, and/or side edges) to provide a "spill proof" panel and/or one or more support legs to support the shelf panel inside and/or outside of the appliance. Moreover, the all-glass shelf panel 22 can obviate any plastic side edges or the like. In addition or alternatively, a handle 27 can be removably or non-removably fixed along at least a portion of the front edge 26 to facilitate user manipulation of the shelf panel 22.

Figure 6:
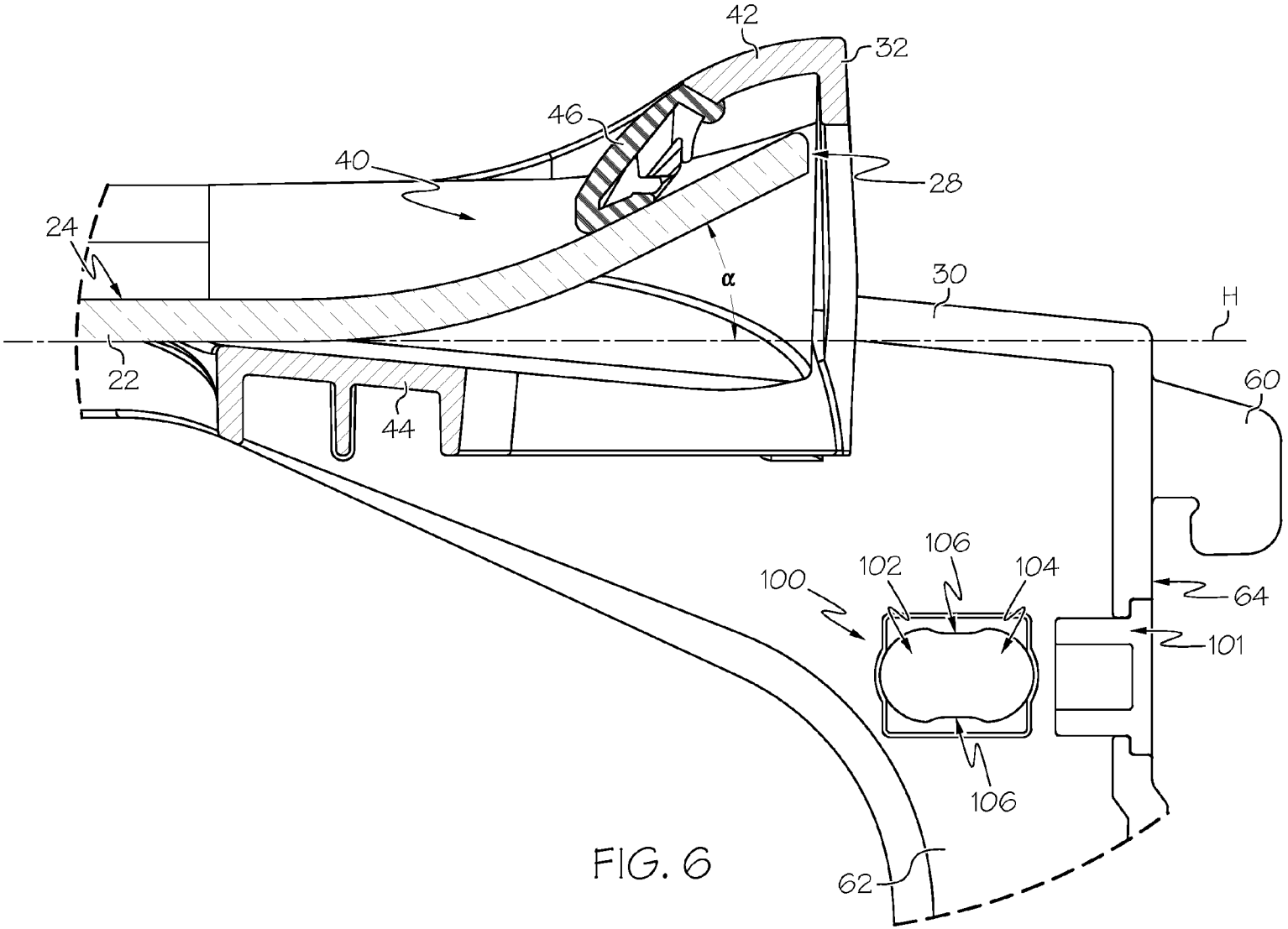
FIG. 6 is a detail view of FIG. 5A illustrating an example shelf panel.
Figure 7:
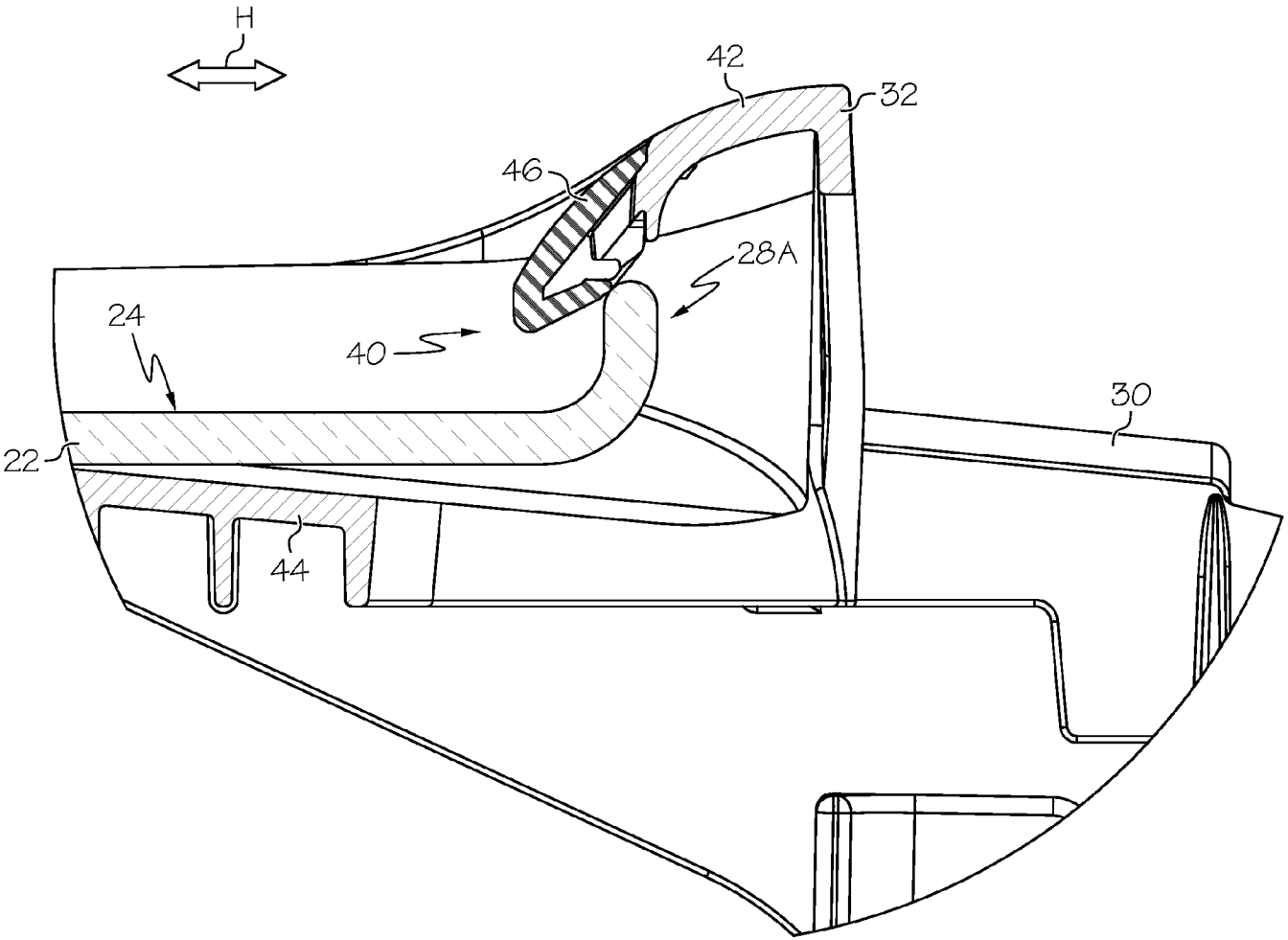
FIG. 7 is similar to FIG. 6, but illustrates another example shelf panel.

Turning briefly to FIG. 6, the rear edge 28 of shelf panel 22 generally includes a raised profile extending away from the support surface 24. The rear edge 28 can extend generally upwards or even generally downwards. In one example, the rear edge 28 is arranged at an angle $\alpha$ with respect to the support surface 24. The angle $\alpha$ of the rear edge 28 is preferably within the range of about 20 degrees to about 45 degrees, although various other angles are contemplated. As shown in FIG. 6, the angle $\alpha$ is shown to be about 45 degrees. Alternatively, as shown in FIG. 7, the rear edge 28A can have a relatively more abrupt profile with relatively larger angle $\alpha$, such as about 90 degrees (i.e., perpendicular) or other angle.

Turning back to FIGS. 2-3, the shelf assembly 20 further includes the frame 30 configured to be mounted to the refrigerator 200 to support the shelf panel 22 with the support surface 24 extending generally along a horizontal plane. Of course, the frame 30 could also be configured to support the shelf panel 22 in various other orientations. The frame 30 includes an elongated rear support member 32 that extends laterally between a pair of side supports 34 configured to support the shelf panel 22. Each of the pair of side supports 34 extends outwards from the rear support member 32 to support the shelf panel along the horizontal plane. The frame 30 can be formed of a generally rigid material, such as metal, plastic, or the like. In one example, the frame 30 can be formed of a cast metal, and may be formed as a monolithic unit. Still, the frame 30 can be assembled from various elements. In addition or alternatively, the side supports 34 can be integrally formed together with the rear support member 32. In addition or alternatively, the shelf panel 22 defines a length extending between the rear edge 28 and the opposite front edge 26, and the side supports 34 can extend along a sufficient distance of the length of the shelf panel 22 to inhibit the forward tiling. The side supports 34 can extend along about 100% of the length of the shelf panel 22, or can even extend less such as about 90% or less, about 80% or less, about 70% or less, about 60% or less, or even about 50% or less. When the support surface 24 is loaded via food or the like beyond the length of the side supports 34, the rear support member 32 can engage the rear edge 28 of the shelf panel 22, as will be described herein, to inhibit the shelf panel 22 from tilting forward to due the loading.

The frame 30 further includes a support channel 40 extending at least partially into the rear support member 32. The support channel 40 is configured to removably receive and capture the rear edge 28 of the shelf panel 22 to inhibit removal of the shelf panel 22 from the frame 30 in the direction of the horizontal plane H (see FIG. 5A). The support channel 40 can facilitate retention of the shelf panel 22 on the frame 30 without the use of an adhesive, mechanical fasteners, or the like. In other words, when the rear edge 28 of the shelf panel 22 is received and captured within the support channel 40, the shelf panel 22 cannot be removed from the frame 30 along the direction of the horizontal plane H without further manipulation of the shelf panel 22.

The support channel 40 can be a generally contiguous (or even non-contiguous) channel that extends along a substantial portion of the rear edge 28 of the shelf panel 22, such as at least about 50% of the rear edge 28. The support channel 40 can be defined between an upper support 42 and a lower support 44, either or both of which can be integrally formed together with the frame 30. In one example, as shown in FIG. 2, the upper support 42 can have a curved geometry that curves upwards and around the rear edge 28 of the shelf panel 22. Still, various other geometries can be contemplated. The support channel 40 can be defined between the upper and lower supports 42, 44 so as to be arranged at an angle substantially corresponding to the angle $\alpha$ of the rear edge 28 of the support surface 24. For example, the support channel 40 can be arranged at an upwards angle substantially corresponding to the upwards angle $\alpha$ of the rear edge 28 of the support surface 24. In addition or alternatively, the support channel 40 can include a cross-sectional area substantially corresponding to the rear edge 28 of the support surface 24.

Either or both of these geometries can facilitate insertion and removal of the shelf panel 22 on the frame 30, as well as to help maintain the rear edge 28 within the support channel 40.

Additionally, at least one support channel insert 46 can be coupled to the upper support 42 and formed of a material that is different than that of the upper support 42. For example, the support channel insert 46 can be formed of a relatively softer material, such as plastic, rubber or rubberized material, silicone, Teflon, etc. Preferably, the support channel insert 46 is formed of a material that will protect the shelf panel 22 and the rear edge 28 from damage against the support channel 40, and/or a material that will frictionally grip the shelf panel 22 to inhibit movement thereof. The support channel insert 46 can be removably or non-removably coupled to the upper support 42, such as by mechanical fasteners, adhesives, and/or one or more resilient clip-in structures configured to engage corresponding apertures of the upper support 42. At least a portion of the support channel insert 46 can rest upon the shelf panel 22 generally near the rear edge 28 when the rear edge 28 is received within the support channel 40. In addition or alternatively, as shown in FIG. 6, the lower support 44 can be arranged at a generally downwardly sloping angle with respect to the horizontal plane H to facilitate insertion or removal of the shelf panel 22 from the support channel 40, as will be described further herein, and also to accommodate slight manufacturing variations of the shelf panel 22 when formed of a glass material. It is further contemplated that the lower support 44 could also be provided with a support insert (not shown).

Figure 5A:
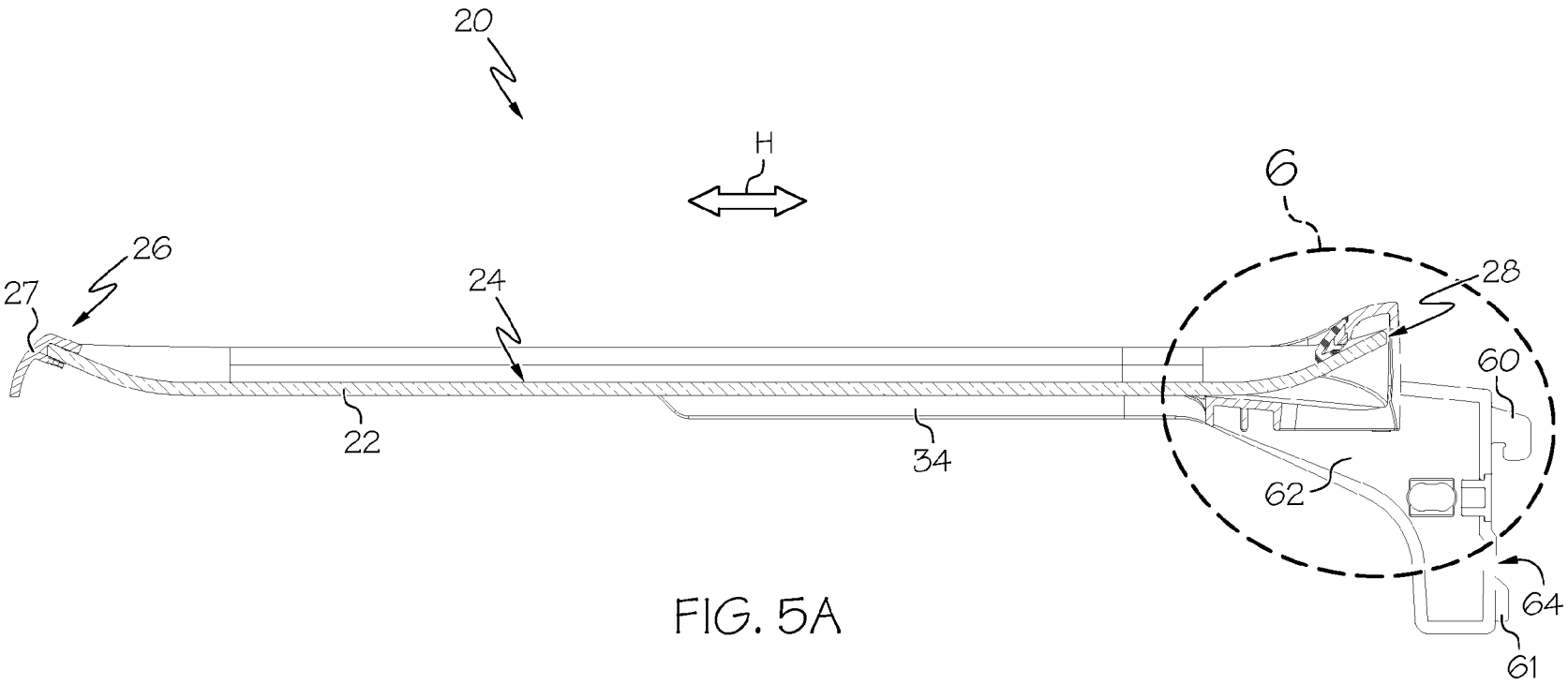
FIG. 5A is a sectional view taken along line 5A-5A of FIG. 4.
Figure 5B:
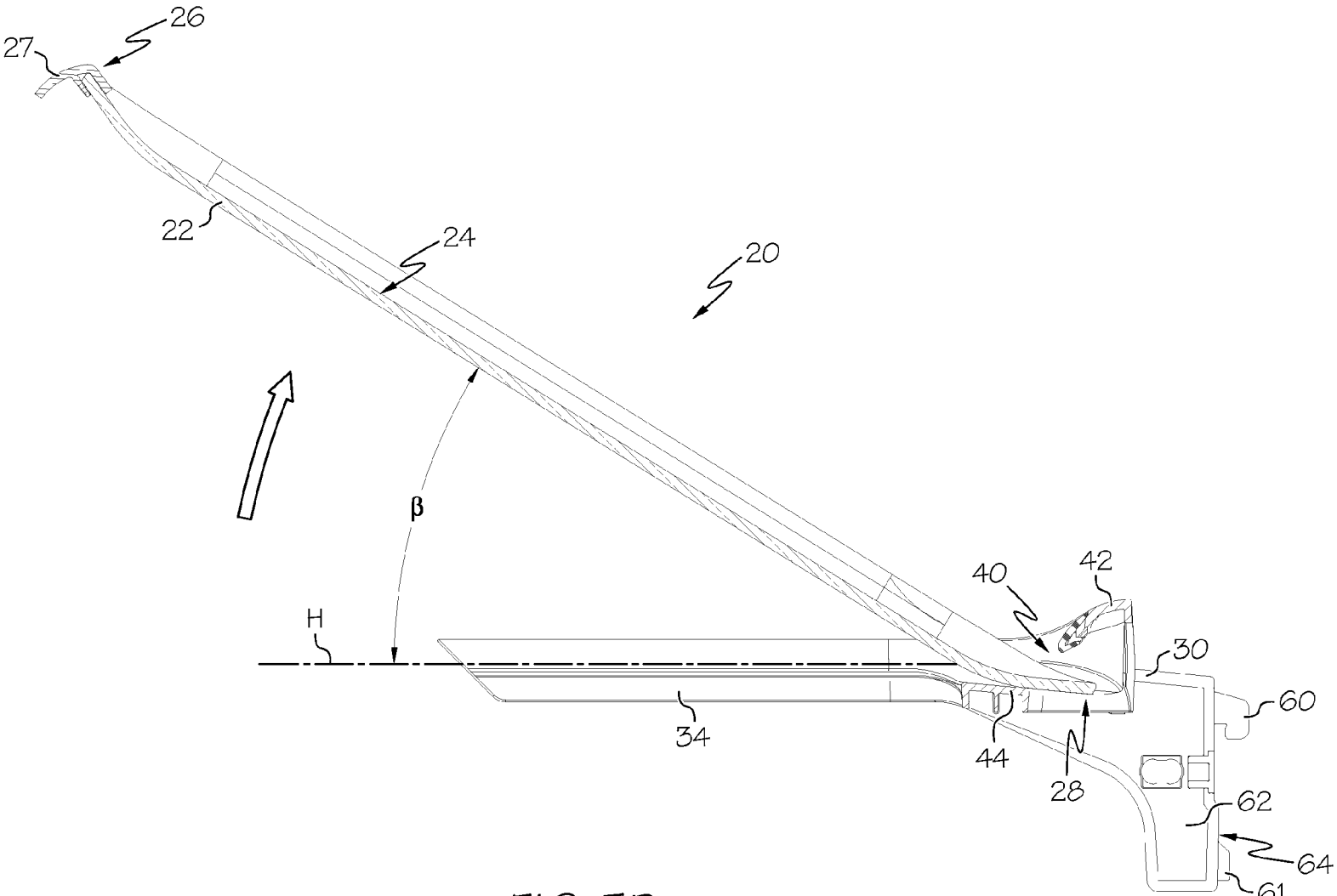
FIG. 5B is similar to FIG. 5A, but shows a shelf panel in an alternative example position.

Turning now to FIGS. 5A-5B, the shelf panel 22 is selectively removable from the support channel 40 by tilting the front edge 26 of the shelf panel 22 upwards to a predetermined angle β relative to the horizontal plane H. The predetermined angle β can have various values, such as in range of about 20 degrees to about 45 degrees. In one example, the predetermined angle is approximately equal to the upwards angle α of the rear edge 28, although the values may not be directly related and may even be adjusted by the downward slope of the lower support 44. In another example, the predetermined angle can be defined by an amount necessary for the rear edge 28 of the shelf panel 22 to become extracted from the support channel 40. By tilting the shelf panel 22 upwards, such as by lifting the front edge 26 upwards via the handle 27, the shelf panel 22 pivots about the lower support 44 of the support channel 40. The rear edge 28 subsequently moves in a downward direction, and can be extracted from the support channel 40 once the rear edge 28 clears the upper support 42 and/or support channel insert 46.

As shown in FIG. 5A, the rear edge 28 is captured within the support channel 40 and is in contact with or at least adjacent to the upper support 42 and/or support channel insert 46. Next, as shown in FIG. 5B, tilting the front edge 26 upwards to the predetermined angle β thereby places the rear edge 28 in a position to be free and clear from the upper support 42 and/or support channel insert 46 so that the shelf panel 22 can be removed from the frame 30 along the horizontal plane, the predetermined angle β, or some other angle therebetween. Conversely, insertion of the shelf panel 22 onto the frame 30 and into the support channel 40 is performed in reverse. That is, the front edge 26 is first tilted upwards at the predetermined angle β sufficient for the rear edge 28 of the shelf panel 22 to clear the upper support 42 and/or support channel insert 46 when the rear edge 28 is inserted into the support channel 40. The shelf panel 22 is pushed backwards into the support channel 40, and the front edge 26 is then lowered downwards until the rear edge 28 is again captured and retained within the support channel 40. Similar insertion and removal procedures can be used for the various different rear edge profiles, such as rear edge 28A shown in FIG. 7, so that the rear edge is clear of the upper support 42 and/or support channel insert 46 during insertion and removal.

The frame 30 can include additional structure to help locate the shelf panel 22 onto the frame 30 during the insertion and removal procedures. For example, turning to FIG. 8, the side edges 29 of the shelf panel 22 can be raised or arranged at an angle relative to the support surface to provide a "spill proof" panel. Similarly, at least a portion of each of the side supports is arranged at an angle to substantially correspond to the angle of an associated side edge 29 of the shelf panel 22. Thus, the shelf panel 22 can be self-centering by the interaction of the angled side edges 29 with the angled portions 35 of the side supports 34. In addition or alternatively, either or both of the pair of side supports 34 can comprise a generally vertical wall 37 extending upwards above each of the side edges 29 of the shelf panel 22 to further enable self-centering of the shelf panel 22 on the frame 30 and/or inhibit accidental removal of the shelf panel 22 from the frame 30. In addition or alternatively, the side supports 34 are formed of a generally rigid material, and either or both of the side supports 34 can include a side support insert 39 formed of a material that is different than that of the side supports 34. The material of the side support insert(s) 39 can be similar to or different from the material of the support channel insert 46, and can similarly protect the shelf panel 22 against damage and/or frictionally grip the shelf panel 22 to inhibit movement thereof It is further contemplated that the side support inserts 39 could be formed together with the support channel insert 46 and/or an insert of the lower support 44.

In addition or alternatively, the frame 30 can further include a pair of hanger members 60 configured to engage corresponding support structure of an appliance for supporting the frame 30 within the refrigerator 200. In one example, the hanger member 60 are hooks that are configured to engage vertically disposed apertures 206 of the adjustment rails 204 to maintain the shelf assembly 20 at the desired elevation within the interior area 202 of the cabinet 209. Turning briefly back to FIGS. 2-3, each hanger member 60 can be provided on a frame support arm 62 located at the rear of the frame 30. A pair of opposed frame support arms 62 can be provided at each end of the frame 30 and generally rearward of the rear support member 32, although various configurations are contemplated. A rear face 64 of the frame support arm 62 can abut the same adjustment rail 204 when one of the hanger members 60 is engaged with a corresponding aperture 206 of the adjustment rail 204. Additionally, one or more auxiliary support members 61 can be provided on the frame support arms 62 that can project outwardly for engagement with other apertures 206 of the adjustment rail 204. The auxiliary support members 61 may provide additional vertical support and/or may be used to align the frame 30 relative to the cabinet and inhibit twisting of the frame 30. To remove the frame 30 from the cabinet 209, a user simply raises the shelf assembly 20 vertically upwards to disengage the hanger members 60 and/or auxiliary support members 61 from the apertures 206.

It can also be beneficial to inhibit, such as prevent, removal of the frame 30 from the cabinet 209. For example, it can be beneficial to inhibit accidental removal of the frame 30 while the shelf panel 22 is being removed or installed onto the frame 30. Turning to FIGS. 9A-11, the shelf assembly 20 can further include a slide latch 70 coupled to the frame 30 that is configured to selectively and lockingly engage corresponding support structure of the appliance to inhibit removal of the hanger members 60 from said adjustment rails 204. The shelf assembly 20 can include one or more slide latches 70, such as a pair of slide latches 70 with one each on a respective frame support arm 62. Only one slide latch 70 will be described for brevity, with the understanding that the other(s) can be similar, or even different.

In one example, the slide latch 70 includes a handle portion 76 configured to be easily manipulated by a user, and an extended portion 78. The slide latch 70 can include at least one raised projection 74 on the extended portion 78 that is configured to lockingly engage a corresponding aperture 206 of the adjustment rail 204. The slide latch 70 can include a plurality of raised projections 74, such as a pair of raised projections 74 that are each configured to engage one or more corresponding apertures 206 of the adjustment rail 204. As shown, the raised projections 74 of the slide latch 70 can be have a dog-bone geometry, though other configurations are contemplated. The slide latches 70 can be selectively moved in a linear fashion relative to the frame 30, generally along the horizontal plane H, into and out of engagement with the adjustment rail 204. The raised projections 74 can include various geometries, such as a curved or angled geometry, configured to readily engage and disengage from corresponding aperture 206 of the adjustment rail 204 when the slide latch 70 is manipulated by the user. Thus, the slide latches 70 can inhibit inadvertent removal of the frame 30 from the refrigerator 200, but permit purposeful removal when desired. In addition or alternatively, at least the end of the extended portion 78 can have an inwardly angled or chamfered geometry to facilitate insertion and removal of the raised projections 74 with the adjustment rails 204. For example, the end of the extended portion can be inwardly angled or chamfered between 10 and 45 degrees, although various angles are contemplated.

The extended portion 78 is movable together with the handle portion 76. In one example, the handle portion 76 can be formed together with the extended portion 78, such as in a monolithic fashion. In addition or alternatively, the slide latch 70 can include a first slide latch element 80 coupled to a second slide latch element 90. It is understood that the identification of first and second is only for convenience, and it not intended as a limitation. The first and second slide latch elements 80, 90 can be removably or non-removably coupled together in various manners. In one example, the first and second slide latch elements 80, 90 are coupled together by a leg 92 of one of the first and second slide latch elements 80, 90 that extends through an aperture 100 of the frame 30. In the shown example, the second slide latch element 90 includes a pair of legs 92 that extend through the aperture 100 of the frame 30 and engage corresponding snap-fit structure 82 of the first slide latch element 80 when the slide latch 70 is assembled onto the frame 30. In addition or alternatively, the second slide latch element 90 can include auxiliary legs 94 that extend through the aperture 100 of the frame 30 and engage corresponding auxiliary snap-fit structure 84 of the first slide latch element 90 to facilitate alignment during assembly. The auxiliary legs 94 can include shoulders 95 that, together with the corresponding auxiliary snap-fit structure 84, can be arranged generally along the direction of the horizontal plane H to transmit force from the handle 76 to the extended portion 78 during use of the slide latch 70 to engage and disengage the raised projections 74 with the adjustment rail 204.

The first slide latch element 80 further includes a receiving hole 81 that extends partially or completely therethrough for receiving the legs 92, 94. Thus, during assembly, the first and second slide latch elements 80, 90 are arranged onto opposite sides of the frame support arm 62 such that the leg 92 extends through the aperture 100 and is coupled to the corresponding snap-fit structure 82 of the first slide latch element 80. Other mechanical fasteners, adhesives, or the like could also be used. Additionally, some or all of the extended portion 78 of the first slide latch element 80 is received in a corresponding slide channel 101 of the frame support arm 62. The slide channel 101 guides movement of the slide latch 70 in the direction of the horizontal plane H to inhibit twisting or pivoting during use. It is contemplated that one or more slide channels 101 can be used on either or both sides of each frame support arm 62.

During use, the slide latch 70 slides relative to the frame 30 such that the legs 92, 94 are moveable within the aperture 100 of the frame 30. It can be beneficial to inhibit movement of the slide latch 70 so that the raised projections 74 are not inadvertently engaged or disengaged from the apertures 206 of the adjustment rails 204. In one example, the aperture 100 can include a first through aperture 102 adjacent to a second through aperture 104. Although shown and described as extending completely through the frame 30, it is contemplated that the apertures 102, 104 could extend only partially into the frame 30. A raised shoulder 106 can be provided therebetween to separate the first and second through apertures 102, 104. As shown, a pair of raised shoulders 106 can be provided, although various numbers and locations can be used. Additionally, at least one of the first and second slide latch elements 80, 90 can include detent structure 88 configured to engage the shoulder 106 to inhibit movement of the slide latch 70 between the first through aperture 102 and the second through aperture 104. The detent structure 88 can have a cross-sectional geometry generally less than the first and second through apertures 102, 104 so as to readily fit therein. However, the detent structure 88 can also have a cross-sectional geometry generally greater than the aperture 100 about the raised shoulder(s) 106 so as to inhibit movement of the slide latch 70 between the first and second through apertures 102, 104. As shown, the first slide latch element 80 can include a pair of detent structures 88 for engagement with a pair of shoulders 106 in the aperture 100, although various numbers and locations of each are contemplated. Thus, in the retracted position in which the raised projections 74 are not engaged with the adjustment rail 204, the slide latch 70 is positioned such that the detent structure 88 is located within the first through aperture 102. When it is desired to selectively lock the frame 30 onto the adjustment rail 204, the slide latch 70 is moved via the handle 76 along the direction of the horizontal plane H and towards the adjustment rail 204 and to an extended position. Initially, the slide latch 70 resists movement to the extended position by abutment of the detent structure 88 with the shoulder 106. However, the detent structure 88 and/or shoulder 106 are configured to flex or otherwise permit sliding movement therebetween upon application of sufficient force. As a result, the detent structure 88 will move beyond the shoulder 106 until it is located in the second through aperture 104. The slide latch 70 is now in the extended position and the raised projections 74 are engaged with the corresponding apertures 206 of the adjustment rail 204 to lock the frame 30 (see FIG. 11). Unlocking the frame 30 is performed in reverse by moving the slide latch 70 in the opposite direction.

Figure 8:
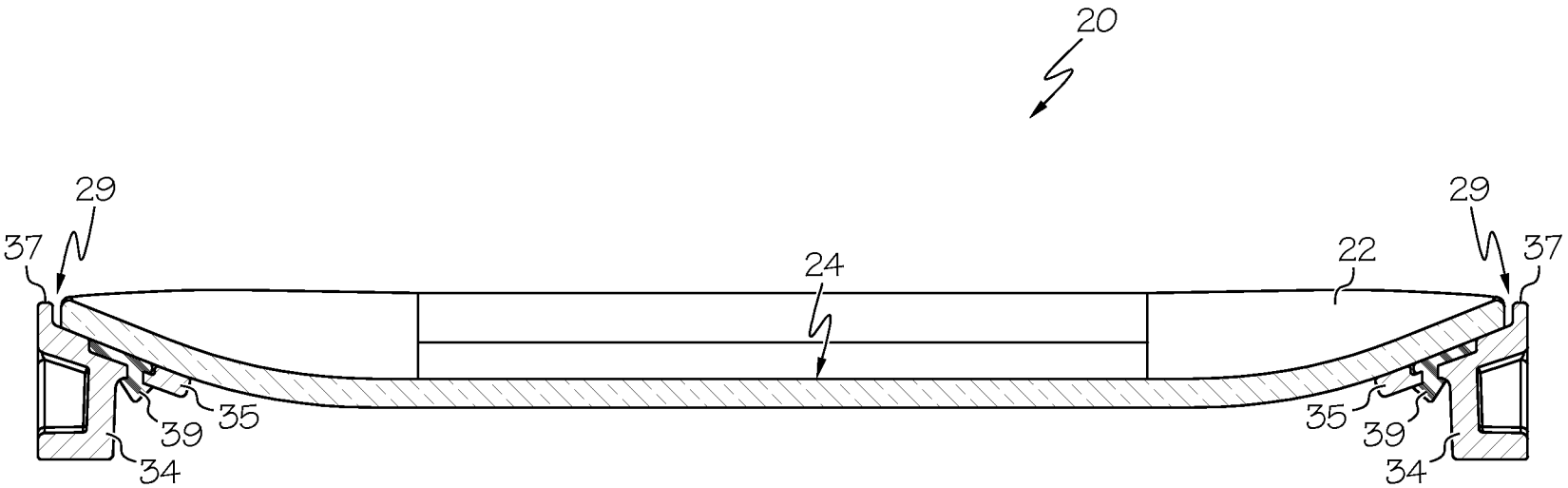
FIG. 8 is a sectional view taken along line 8-8 of FIG. 4.
Figure 9A:
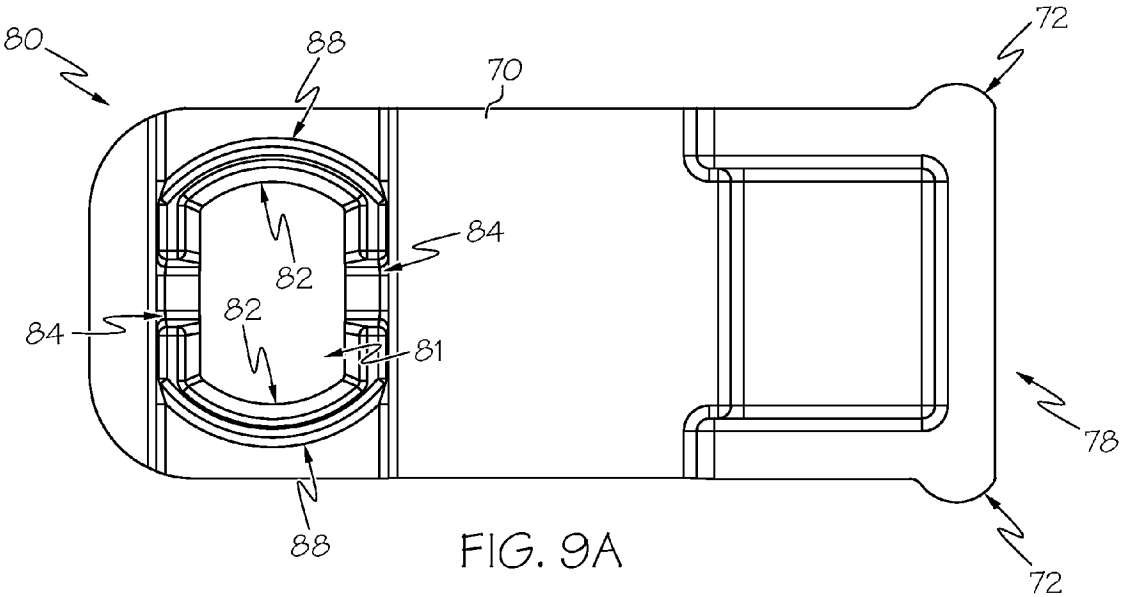
FIG. 9A is a side view of an example first slide latch element.
Figure 9B:
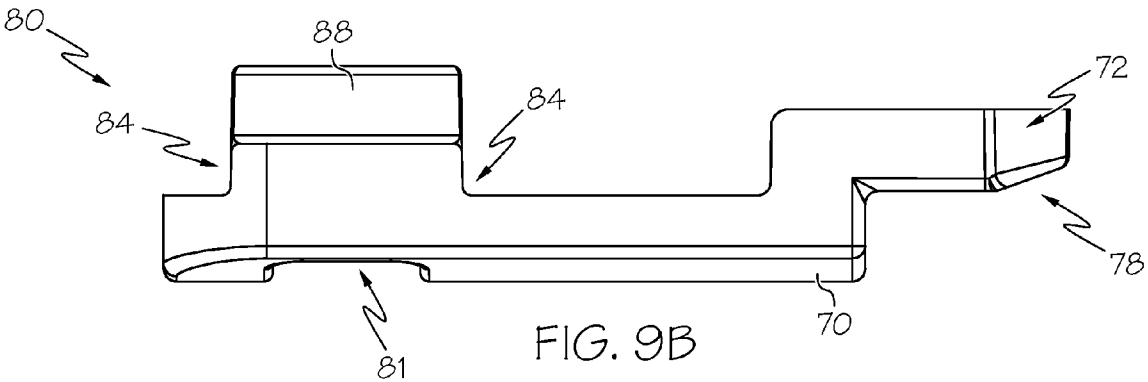
FIG. 9B is a top view of the first slide latch element of FIG. 9A.
Figure 10A:
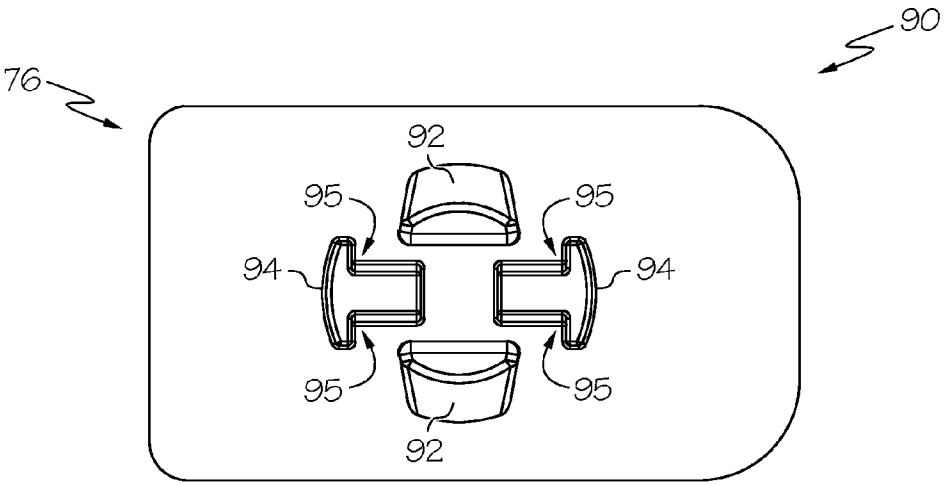
FIG. 10A is a side view of an example second slide latch element.
Figure 10B:
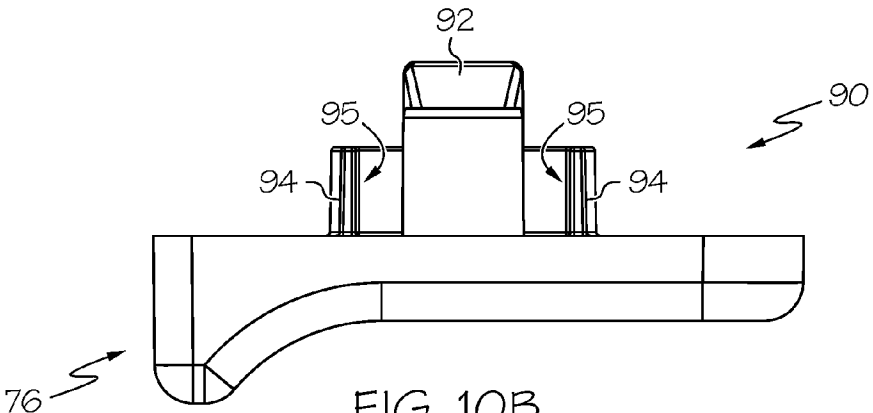
FIG. 10B is a top view of the second slide latch element of FIG. 10A.
Figure 11:
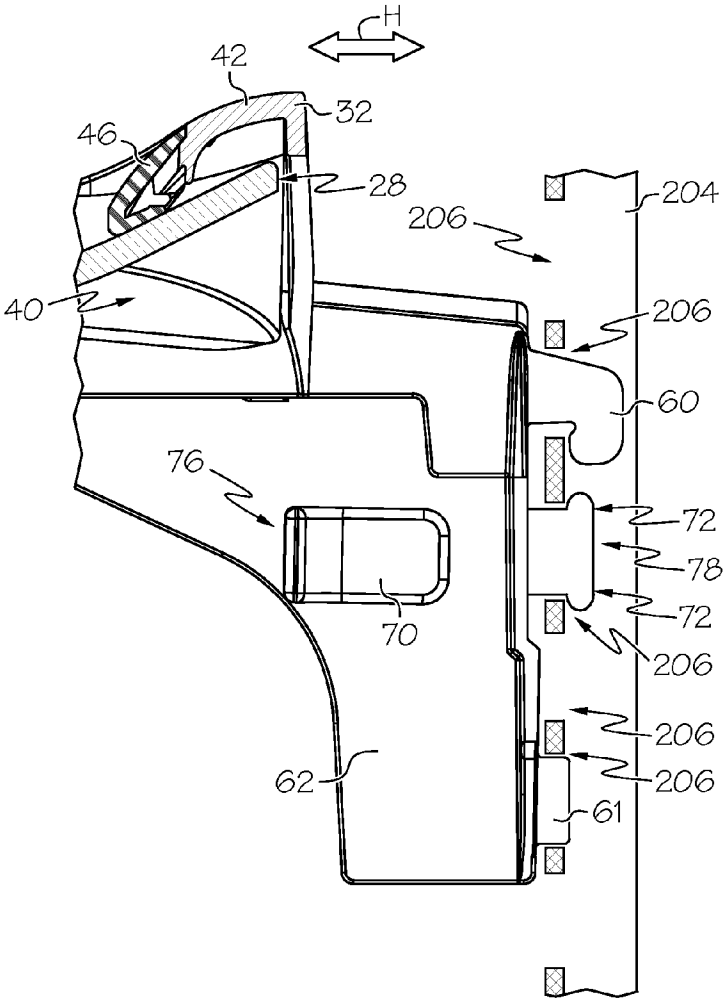
FIG. 11 is a side, detail view illustrating the slide latch of FIG. 9 engaging example support structure of an appliance.
Figure 12B:
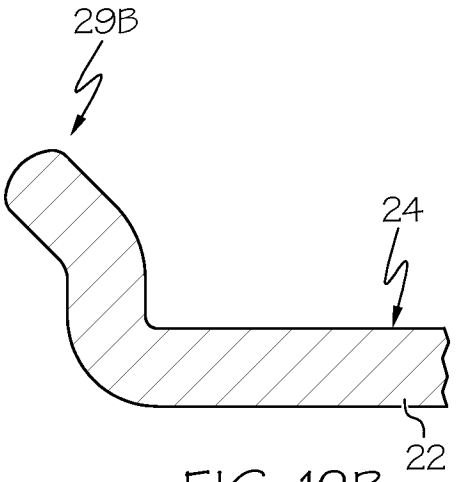
FIGS. 12A-12C are example edge profiles of an example shelf panel.
Figure 12A:
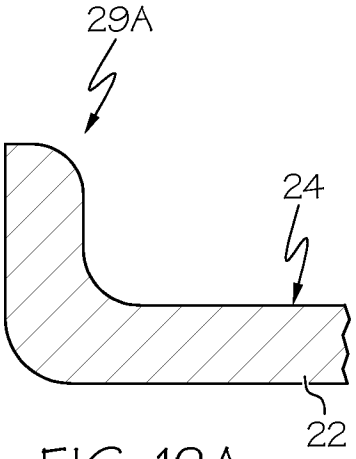
Figure 12C:
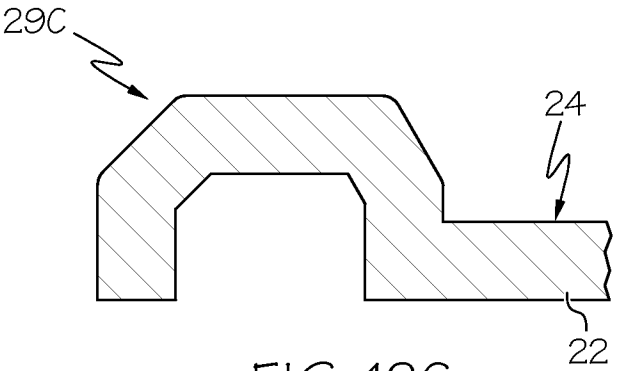

In addition or alternatively to the foregoing, the shelf assembly 20 can include various additional features. In one example, the side edges 29 of the shelf panel 22 can have various other geometries. Referring now to FIGS. 8 and 12A-12C, the shelf panel 22 may further comprise various raised or angled edges extending along the outer perimeter to provide a "spill proof" panel. Use of these or other raised or angled edges with an all-glass shelf panel 22 can provide a "spill proof" panel without any plastic side edges or the like. As shown in FIG. 8, the side edges 29 have a generally gradual upwards slope to retain spills on the support surface 24. Turning to FIGS. 12A-12C, the side edge 29 profiles can have a relatively more abrupt profile with relatively larger upwards angle, such as about 90 degrees (i.e., perpendicular) as the side edge 29A shown in FIG. 12A. Similarly, the abruptness of the upwards angle can be somewhat reduced or softened by a compound angle edge profile that combines a generally perpendicular upwards angle with an outwardly flared portion, such as the side edge 29B shown in FIG. 12B. In another example, the side edge profile can be strengthened by using a profile similar to that of FIG. 12B, but adding additional material and/or additional angled surfaces, such as the side edge 29C shown in FIG. 12C. It is understood that any of all of these (or even other) edge profiles can be used for any of the front edge 26, rear edge 28, or side edges 29.

The invention has been described with reference to the example embodiments described above. Modifications and alterations will occur to others upon a reading and understanding of this specification. Examples embodiments incorporating one or more aspects of the invention are intended to include all such modifications and alterations insofar as they come within the scope of the appended claims.

What is claimed is:

1. A shelf assembly for an appliance, comprising:

a shelf panel comprising a generally planar support surface and a rear edge comprising a raised profile extending away from the support surface;

a frame configured to be mounted to an appliance to support the shelf panel with the support surface extending generally along a horizontal plane, the frame comprising an elongated rear support member and a pair of hanger members configured to be received in and engage corresponding support structure of an appliance for supporting the frame;

a support channel extending at least partially into the rear support member and defined between an upper support and a lower support, the support channel being configured to removably receive and capture a central portion of the rear edge of the shelf panel to inhibit movement of the shelf panel relative to the upper support of the frame; and a slide latch coupled to the frame and comprising a first slide latch element comprising a handle portion integral with an extended portion comprising at least one raised projection located at a terminal end of the extended portion that is configured to selectively and lockingly engage corresponding support structure of an appliance to inhibit removal of the hanger members from said support structure, wherein the first slide latch element is received within an opening of the frame and is slidable within the opening, relative to the frame, in the direction of the horizontal plane to selectively engage the at least one raised projection with said corresponding support structure of said appliance; and wherein the slide latch comprises a second slide latch element adjoined to the first slide latch element via a leg of one of the first and second slide latch elements that extends through the opening of the frame, such that the first and second slide latch elements are located on opposite sides of the frame with the opening extending between said opposite sides of the frame.

2. The shelf assembly of claim 1, wherein the support channel is arranged at an angle substantially corresponding to an angle of the rear edge of the support surface.

3. The shelf assembly of claim 2, wherein the angle of the rear edge is within the range of 20 degrees to 45 degrees.

4. The shelf assembly of claim 1, wherein the support channel comprises a cross-sectional area substantially corresponding to the rear edge of the support surface.

5. The shelf assembly of claim 1, wherein both of the upper support and lower support are integrally formed together with the frame.

6. The shelf assembly of claim 5, further comprising a support channel insert coupled to the upper support and formed of a material that is different than that of the upper support.

7. The shelf assembly of claim 5, wherein the lower support is arranged at a downwardly sloping angle with respect to the horizontal plane.

8. The shelf assembly of claim 1, further comprising a pair of side supports extending outwards from the rear support member to support the shelf panel, wherein the side supports are formed of a first material, and wherein each of the side supports comprises a side support insert formed of a second material that is different than the first material of the side supports.

9. The shelf assembly of claim 8, wherein the side supports are integrally formed together with the rear support member.

10. The shelf assembly of claim 8, wherein the shelf panel comprises a pair of side edges arranged at an angle relative to the support surface, and wherein at least a portion of each of the side supports is arranged at an angle to substantially correspond to the angle of an associated side edge of the shelf panel.

11. The shelf assembly of claim 8, wherein the shelf panel defines a length extending between the rear edge and an opposite front edge, and wherein the side supports extend along about 50% or less of the length of the shelf panel.

12. The shelf assembly of claim 1, wherein the support channel is a generally contiguous channel extending along at least about 50% of the rear edge of the shelf panel.

13. The shelf assembly of claim 1, wherein the opening further comprises a first through aperture adjacent to a second through aperture, and a shoulder that separates the first and second through apertures, and wherein at least one of the first slide latch element and the second slide latch element comprises detent structure configured to engage the shoulder to inhibit movement of the slide latch between the first through aperture and the second through aperture.

14. The shelf assembly of claim 1, wherein the support channel inhibits removal of the shelf panel from the frame in the direction of the horizontal plane until the front edge of the shelf panel is tilted upwards to a predetermined angle relative to the horizontal plane.

15. A shelf assembly for an appliance, comprising:

a shelf panel comprising a generally planar support surface and a rear edge comprising a raised profile extending away from the support surface;

a frame configured to be mounted to an appliance to support the shelf panel with the support surface extending generally along a horizontal plane, the frame comprising an elongated rear support member and a pair of hanger members configured to be received in and engage corresponding support structure of an appliance for supporting the frame;

a support channel extending at least partially into the rear support member and defined between an upper support and a lower support, the support channel being configured to removably receive and capture a central portion of the rear edge of the shelf panel to inhibit movement of the shelf panel relative to the upper support of the frame; and a slide latch coupled to the frame and comprising a handle portion and an extended portion comprising at least one raised projection located at a terminal end of the extended portion that is configured to selectively and lockingly engage corresponding support structure of an appliance to inhibit removal of the hanger members from said support structure, wherein the slide latch is received within an opening of the frame and is slidable within the opening, relative to the frame, in the direction of the horizontal plane to selectively engage the at least one raised projection with said corresponding support structure of said appliance; and wherein the extended portion of the slide latch is received in a corresponding slide channel of the frame that guides linear movement of the slide latch in the direction of the horizontal plane to inhibit twisting or pivoting of the extended portion;

wherein the opening extends through the frame, and wherein the slide latch element comprises a first slide latch element and a second slide latch element adjoined to the first slide latch element via a leg of one of the first and second slide latch elements that extends through the opening of the frame, such that the first and second slide latch elements are located on opposite sides of the frame with the opening extending between said opposite sides of the frame.

16. The shelf assembly of claim 15, wherein the opening further comprises a first through aperture adjacent to a second through aperture, and a shoulder that separates the first and second through apertures, and wherein the slide latch comprises detent structure configured to engage the shoulder to inhibit movement of the slide latch between the first through aperture and the second through aperture.

17. The shelf assembly of claim 15, wherein the support channel inhibits removal of the shelf panel from the frame in the direction of the horizontal plane until the front edge of the shelf panel is tilted upwards to a predetermined angle relative to the horizontal plane.

* * * * *